US012797763B2

(12) United States Patent
Egli et al.

(10) Patent No.: US 12,797,763 B2
(45) **Date of Patent: *Nov. 17, 2026**

(54) VEHICLE SUSPENSION MOVING SYSTEM

(71) Applicant: Namero, LLC, Phoenix, AZ (US)

(72) Inventors: Alaric R. Egli, New River, AZ (US); Matthew R. Jackson, Mesa, AZ (US); Darin Oreman, Tempe, AZ (US); Jeroen de Vries, Almere (NL)

(73) Assignee: Namero, LLC, Phoenix, AZ (US)

( * ) Notice: Subject to any disclaimer, the term of this patent is extended or adjusted under 35 U.S.C. 154(b) by 369 days.

This patent is subject to a terminal disclaimer.

(21) Appl. No.: 18/635,786

(22) Filed: Apr. 15, 2024

(65) Prior Publication Data

US 2024/0269575 A1 Aug. 15, 2024

Related U.S. Application Data

(63) Continuation-in-part of application No. 17/367,090, filed on Jul. 2, 2021, now Pat. No. 11,957,993, which is a continuation of application No. 16/181,223, filed on Nov. 5, 2018, now Pat. No. 11,083,973.

(60) Provisional application No. 62/584,038, filed on Nov. 9, 2017.

(51) Int. Cl.
*A63H 17/26* (2006.01)

(52) U.S. Cl.
CPC ..... *A63H 17/262* (2013.01)

(58) Field of Classification Search
CPC .... A63H 17/262; A63H 17/004; A63H 17/36; A63H 29/00; B60G 2300/20; B60G 2204/128; B60G 15/067; B60G 2204/421; B60G 2204/14; B60G 2204/1431; B60G 2200/46; B62K 5/10; B62D 9/02
See application file for complete search history.

(56) References Cited

U.S. PATENT DOCUMENTS

| | | | | |
|---|---|---|---|---|
| 2,152,938 A | | 4/1939 | Welch | |
| 2,167,245 A | | 7/1939 | Lohr et al. | |
| 3,109,668 A | | 11/1963 | Sampietro | |
| 3,198,541 A | | 8/1965 | Christenson et al. | |
| 3,306,167 A | | 2/1967 | Ramseyer | |
| 3,423,099 A | | 1/1969 | De Mars | |
| 3,497,233 A | * | 2/1970 | Bolaski, Jr. ..... | B60G 21/007 280/124.109 |
| 3,820,497 A | | 6/1974 | Konijn | |

(Continued)

FOREIGN PATENT DOCUMENTS

| | | | |
|---|---|---|---|
| EP | 1346907 A2 * | 9/2003 | ..... B62K 5/10 |
| EP | 1362779 A2 * | 11/2003 | ..... B60G 21/05 |

(Continued)

OTHER PUBLICATIONS

U.S. Appl. No. 62/584,038, filed Nov. 9, 2017.

(Continued)

*Primary Examiner* — John E Simms, Jr.
*Assistant Examiner* — Amir A Klayman
(74) *Attorney, Agent, or Firm* — Craig R. Miles; CR MILES P.C.

(57) ABSTRACT

A toy vehicle suspension operable to lift and lower the vehicle chassis of the toy vehicle. In particular embodiments, the vehicle suspension transmits sufficient forces to the wheels of the toy vehicle to enable the wheels to hop off the ground.

29 Claims, 10 Drawing Sheets

(56) References Cited

U.S. PATENT DOCUMENTS

| | | | | |
|---|---|---|---|---|
| 3,820,615 | A | 6/1974 | Bobard | |
| 3,838,604 | A | 10/1974 | Meister | |
| 4,109,747 | A | 8/1978 | Hornagold et al. | |
| 4,406,472 | A | 9/1983 | Furukawa | |
| 4,573,941 | A | 3/1986 | Holden et al. | |
| 4,600,216 | A | 7/1986 | Burkholder | |
| 4,650,213 | A | 3/1987 | Fujita et al. | |
| 4,696,655 | A | 9/1987 | D'Andrade et al. | |
| 4,703,824 | A | 11/1987 | Irimajiri et al. | |
| 4,784,406 | A * | 11/1988 | Stinson | B60G 21/0551 280/124.149 |
| 4,958,584 | A | 9/1990 | Williamson | |
| 4,999,003 | A | 3/1991 | Koishi et al. | |
| 5,020,308 | A | 6/1991 | Braun et al. | |
| 5,048,860 | A | 9/1991 | Kanai et al. | |
| 5,080,389 | A | 1/1992 | Kawano et al. | |
| 5,334,077 | A | 8/1994 | Bailey | |
| 5,458,359 | A | 10/1995 | Brandt | |
| 5,485,653 | A | 1/1996 | Knowlton et al. | |
| 5,531,466 | A | 7/1996 | Hayashi | |
| 5,590,617 | A | 1/1997 | Gere et al. | |
| 5,700,026 | A | 12/1997 | Zalewski et al. | |
| 5,722,872 | A | 3/1998 | Simmons et al. | |
| 5,785,576 | A | 7/1998 | Belton | |
| 5,890,558 | A | 4/1999 | Keegan | |
| 6,015,330 | A | 1/2000 | Simmons et al. | |
| 6,036,575 | A | 3/2000 | Rehkemper et al. | |
| 6,182,979 | B1 | 2/2001 | Lee | |
| 6,357,268 | B1 | 3/2002 | Takimoto | |
| 6,383,054 | B1 | 5/2002 | Rauch | |
| 6,467,783 | B1 * | 10/2002 | Blondelet | B60G 21/05 280/5.521 |
| 6,478,655 | B2 * | 11/2002 | Wu | A63H 17/262 446/469 |
| 6,510,917 | B2 | 1/2003 | Cole | |
| 6,530,586 | B2 | 3/2003 | Fader et al. | |
| 6,547,260 | B2 | 4/2003 | Laurent et al. | |
| 6,620,023 | B2 | 9/2003 | Yeung | |
| 6,637,758 | B2 | 10/2003 | Woo | |
| 6,679,752 | B1 | 1/2004 | Reed, Sr. | |
| 6,719,313 | B2 | 4/2004 | Zadok | |
| 6,758,719 | B1 | 7/2004 | Nava | |
| 6,767,272 | B2 | 7/2004 | Santarsiero | |
| 6,793,228 | B2 | 9/2004 | Zadok | |
| 6,942,230 | B1 | 9/2005 | Fontdecaba Buj | |
| 6,945,843 | B1 | 9/2005 | Motosko | |
| 7,063,179 | B2 | 6/2006 | Takayanagi et al. | |
| 7,108,096 | B1 | 9/2006 | Oxley et al. | |
| 7,237,779 | B2 * | 7/2007 | Kondo | B60P 1/027 280/6.157 |
| 7,278,511 | B1 | 10/2007 | Gass et al. | |
| 7,343,997 | B1 | 3/2008 | Matthies | |
| 7,407,173 | B2 | 8/2008 | Walker | |
| 7,530,419 | B2 | 5/2009 | Brudeli | |
| 7,625,001 | B2 | 12/2009 | Pavuk | |
| 7,665,742 | B2 | 2/2010 | Haerr et al. | |
| 7,749,047 | B2 | 7/2010 | Dunham | |
| 7,887,074 | B2 | 2/2011 | Byers et al. | |
| 7,914,025 | B2 | 3/2011 | Mayen et al. | |
| 7,922,184 | B2 | 4/2011 | Poreheron | |
| 8,128,110 | B2 | 3/2012 | Saeli | |
| 8,272,470 | B2 | 9/2012 | Karlsson | |
| 8,302,728 | B1 | 11/2012 | Dotson | |
| 8,380,394 | B1 | 2/2013 | Snodgrass | |
| 8,480,106 | B1 | 7/2013 | Cohen | |
| 8,607,914 | B2 | 12/2013 | Lee et al. | |
| 8,641,064 | B2 | 2/2014 | Krajekian | |
| 8,662,228 | B2 | 3/2014 | Hill et al. | |
| 8,764,040 | B1 | 7/2014 | DeLauter | |
| 8,925,940 | B2 | 1/2015 | Mighell | |
| 9,096,261 | B2 | 8/2015 | Aldrich | |
| 9,120,511 | B1 | 9/2015 | Beard | |
| 9,527,543 | B2 | 12/2016 | Mercier | |
| 10,413,838 | B2 * | 9/2019 | Chu | A63H 17/264 |
| 10,603,955 | B2 | 3/2020 | Abramov et al. | |
| 11,083,973 | B2 | 8/2021 | Egli et al. | |
| 11,117,434 | B2 | 9/2021 | Budweil | |
| 11,241,636 | B2 * | 2/2022 | Vetuskey | A63H 17/262 |
| 11,318,394 | B2 * | 5/2022 | Rydwell | A63H 17/262 |
| 11,472,474 | B2 * | 10/2022 | Araki | B62D 1/04 |
| 11,957,993 | B2 | 4/2024 | Egli et al. | |
| 2002/0077026 | A1 | 6/2002 | Li | |
| 2003/0116935 | A1 | 6/2003 | Zadok | |
| 2003/0164603 | A1 | 9/2003 | Zadok | |
| 2005/0275181 | A1 | 12/2005 | Macisaac | |
| 2006/0172628 | A1 | 8/2006 | Longdill et al. | |
| 2007/0075517 | A1 | 4/2007 | Suhre et al. | |
| 2007/0182120 | A1 | 8/2007 | Tonoli et al. | |
| 2008/0197597 | A1 | 8/2008 | Moulene et al. | |
| 2008/0303227 | A1 * | 12/2008 | Chi Chun Idiot | A63H 17/262 280/1 |
| 2009/0256326 | A1 | 10/2009 | Sacli | |
| 2010/0164189 | A1 | 7/2010 | Buma | |
| 2011/0048833 | A1 | 3/2011 | Schapf et al. | |
| 2011/0095505 | A1 | 4/2011 | Heath | |
| 2013/0062133 | A1 | 3/2013 | Budweil | |
| 2013/0241168 | A1 | 9/2013 | Michel | |
| 2014/0227941 | A1 | 8/2014 | Suzuki | |
| 2014/0306415 | A1 | 10/2014 | Aldrich | |
| 2014/0312580 | A1 | 10/2014 | Gale | |
| 2014/0346753 | A1 | 11/2014 | Huang et al. | |
| 2016/0016451 | A1 | 1/2016 | Izak | |
| 2016/0075200 | A1 | 3/2016 | Hansen et al. | |
| 2016/0159180 | A1 | 6/2016 | Palatov | |
| 2017/0057351 | A1 | 3/2017 | Bandy | |
| 2019/0144035 | A1 | 5/2019 | Doerksen et al. | |

FOREIGN PATENT DOCUMENTS

| | | | | |
|---|---|---|---|---|
| GB | 2131363 | A | 6/1984 | |
| GB | 2354984 | A | 4/2001 | |
| GB | 2437812 | A * | 11/2007 | A63H 17/262 |
| WO | WO-2008044838 | A1 * | 4/2008 | B62K 5/027 |

OTHER PUBLICATIONS

U.S. Appl. No. 16/181,223, filed Nov. 5, 2018.

PCT International Patent Application No. PCT/US18/59692, International Search Report and Written Opinion of the International Searching Authority dated Jan. 22, 2019, 14 pages.

Youtube. Wicked '67 RC Lowrider by Jervies . . . Video, https://www.youtube.com/watch?v=N8EQLCIcgqs, published Jan. 1, 2016.

Youtube. BeSwitched '67 RC scale lowrider by Jevries. Video, https://www.youtube.com/watch?v=H4bGX9rdAjk, published Apr. 2, 2015.

Youtube. RC '64 Chevy Impala at the Tokyo lowrider show 2011. Video, https://www.youtube.com/watch?v=F3JYhSFtIX8, published May 17, 2013.

Youtube. Lowrider RC Homie Hopper. Video, https://www.youtube.com/watch?v=Bc094uOH6nU. published Apr. 18, 2012.

Youtube. Hopping Homie Hopper. Video, https://www.youtube.com/watch?v=23UvilkvNMI, published Jul. 30, 2009.

Youtube. All my Homie Hoppers plus a few more lowrider toys. Video, https://www.youtube.com/watch?v=CKayyZtimf4, published Nov. 20, 2015.

Youtube. Homie Hoppers Blvd Bouncer. Video, https://www.youtube.com/watch?v=kJFnlB31d3U, published Feb. 2, 2013.

Youtube. Lindberg Homie Hoppers '63 Impara 1:18 R/C. Video, https://www.youtube.com/watch?v=tY6ZakfpZiA, published Mar. 26, 2017.

Youtube. Homie Hopper. Video, https://www.youtube.com/watch?v=H2mMDfN8hGs, published Jul. 15, 2009.

Youtube. 1964 Chevrolet Impala Model Lowrider Dancer on Servos Hydraulics. Video, https://www.youtube.com/watch?v=yPfFpDZZAr8, published Sep. 25, 2014.

Youtube. Hopping Homies Hopper 2. Video, https://www.youtube.com/watch?v=e7YjwkJLTSk, published Sep. 14, 2009.

U.S. Appl. No. 16/181,223, Office Action mailed Sep. 11, 2019.

U.S. Appl. No. 16/181,223, Office Action mailed Mar. 3, 2020.

U.S. Appl. No. 16/181,223, Office Action mailed Feb. 5, 2021.

(56) References Cited

OTHER PUBLICATIONS

U.S. Appl. No. 17/367,090, Office Action mailed Nov. 4, 2022.
U.S. Appl. No. 17/367,090, Office Action mailed Apr. 19, 2023.

* cited by examiner

VEHICLE SUSPENSION MOVING SYSTEM

This United States Patent Application is a continuation-in-part of U.S. patent application Ser. No. 17/367,090, filed Jul. 2, 2021, now U.S. Pat. No. 11,957,993, issued Apr. 16, 2024, which is a continuation of U.S. patent application Ser. No. 16/181,223, filed Nov. 5, 2018, now U.S. Pat. No. 11,083,973, issued Aug. 10, 2021, which claims the benefit of U.S. Provisional Patent Application No. 62/584,038, filed Nov. 9, 2017, each hereby incorporated by reference herein.

FIELD OF THE INVENTION

A vehicle suspension operable to individually lift and lower the left side of a vehicle chassis or the right side of a vehicle chassis or concurrently lift and lower the left side of a vehicle chassis and the right side of a vehicle chassis of a toy vehicle. In particular embodiments, the vehicle suspension transmits sufficient force to the wheels of the toy vehicle to enable the wheels to hop off the ground.

SUMMARY OF THE INVENTION

A broad object of particular embodiments of the invention can be to provide an embodiment of a vehicle suspension apparatus including one or more of: a central bell crank pivotally mounted on a vehicle chassis to axially pivot along a longitudinal axis of the vehicle chassis; a first link having a first link end connected to a first bell crank pivotally mounted on the vehicle chassis to transversely pivot along a transverse axis across the longitudinal axis of the vehicle chassis and a second link end connected to the central bell crank; a second link adjacent to the first link and having a first link end connected to a second bell crank pivotally mounted on the vehicle chassis to transversely pivot along a transverse axis across the longitudinal axis of the vehicle chassis and a second link end connected to the central bell crank; and, a connecting rod pivotally connected at a first end to the central bell crank and pivotally connected at a second end to a rotary actuator.

Another broad object of particular embodiments of the invention can be to provide an embodiment of a vehicle suspension apparatus including: a first adjustable-length member having a first mount connected to a first bell crank pivotally mounted on the vehicle chassis to transversely pivot along a transverse axis across the longitudinal axis of the vehicle chassis. A first vertical suspension assembly pivotally connected to the vehicle chassis interconnects a first wheel to a second mount of the first adjustable-length member.

Another broad object of particular embodiments of the invention can be to provide an embodiment of a vehicle suspension apparatus including: a second adjustable-length member having a first mount connected to a second bell crank pivotally mounted on the vehicle chassis to transversely pivot along a transverse axis across the longitudinal axis of the vehicle chassis. A second vertical suspension assembly pivotally connected to the vehicle chassis interconnects a second wheel to a second mount of the first adjustable-length member.

Another broad object of the invention can be to perform a method including one or more of: operating a rotary actuator to generate a pull force via a connecting rod connected to the rotary actuator; generating a radial force axially along a longitudinal axis of a vehicle chassis via a central bell crank connected to the connecting rod; transferring the radial force along a transverse axis across the longitudinal axis of the vehicle chassis via a first bell crank or a second bell crank linked to the central bell crank; and transmitting the radial force dispersed through the first bell crank or the second bell crank through corresponding first or second adjustable-length members to a first vertical suspension or a second vertical suspension assembly with sufficient force to enable the first or second wheel to hop off a support surface. In particular embodiments, the method can include concurrently transmitting the radial force dispersed through the first bell crank or the second bell crank through corresponding first and second adjustable-length members to a first vertical suspension and a second vertical suspension assembly with sufficient force to enable both first and second wheels to hop off the support surface.

Another broad object of particular embodiments of the invention can be to provide an embodiment of a vehicle suspension apparatus including one or more of: a first central bell crank pivotally mounted on a vehicle chassis, the first central bell crank mounted to axially pivot along a longitudinal axis of the vehicle chassis; a first bell crank pivotally mounted on the vehicle chassis, the first bell crank mounted to transversely pivot along a transverse axis of the vehicle chassis; a first link having a first end connected to the first bell crank and a second end connected to the first central bell crank; a first mount of a first member connected to the first bell crank; a second mount of the first member connected to a first vertical suspension assembly pivotally coupled to the vehicle chassis; and a first wheel interconnected to the first vertical suspension assembly, wherein operative interconnection of the first central bell crank, the first bell crank and the first member moves the first wheel to lift and lower one of the left side or the right side of a vehicle chassis, wherein a first connecting rod can have a first end pivotally connected to the first central bell crank and a second end pivotally connected to a first rotary actuator.

Another broad object of particular embodiments of the invention can be to provide an embodiment of a vehicle suspension apparatus including one or more of: a second central bell crank pivotally mounted on the vehicle chassis, the second central bell crank mounted to axially pivot along the longitudinal axis of the vehicle chassis; a second bell crank pivotally mounted on the vehicle chassis, the second bell crank mounted to transversely pivot along a transverse axis of the vehicle chassis; a first link having a first end connected to the second bell crank and a second end connected to the second central bell crank; a first mount of a second member connected to the second bell crank; a second mount of the second member connected to a second vertical suspension assembly pivotally coupled to the vehicle chassis; and a second wheel interconnected to the second vertical suspension assembly, wherein operative interconnection of the second central bell crank, the second bell crank and the second member moves the second wheel to lift and lower one of the left side or the right side of a vehicle chassis, wherein a first connecting rod can have a first end pivotally connected to the second central bell crank and a second end pivotally connected to a second rotary actuator.

Another broad object of particular embodiments of the invention can be to provide an embodiment of a vehicle suspension apparatus including one or more of: a first central bell crank and a second central bell crank each pivotally mounted on the vehicle chassis, the first and second central bell cranks mounted to axially pivot along the longitudinal axis of the vehicle chassis; a first bell crank and a second bell crank pivotally mounted on the vehicle chassis, the first and second bell crank mounted to transversely pivot along a transverse axis of the vehicle chassis; a first link having a first end connected to the first bell crank and a second end connected to the first central bell crank; a second link having a first end connected to the second bell crank and a second end connected to the second central bell crank; a first mount of a first member connected to the first bell crank and a second mount of the first member connected to a first vertical suspension assembly pivotally coupled to the vehicle chassis a first wheel interconnected to the first vertical suspension assembly; a first mount of a second member connected to the second bell crank and a second mount of the second member connected to a second vertical suspension assembly pivotally coupled to the vehicle chassis; and a second wheel interconnected to the second vertical suspension assembly, wherein operative interconnection of the first central bell crank, the first bell crank and the first member moves the first wheel to lift and lower one of the left side or the right side of a vehicle chassis, wherein a first connecting rod can have a first end pivotally connected to the first central bell crank and a second end pivotally connected to a first rotary actuator, and wherein operative interconnection of the second central bell crank, the second bell crank and the second member moves the second wheel to lift and lower one of the left side or the right side of a vehicle chassis, wherein a first connecting rod can have a first end pivotally connected to the second central bell crank and a second end pivotally connected to a second rotary actuator.

Another broad object of the invention can be to perform a method including one or more of: operating a first rotary actuator to generate a pull force via a first connecting rod connected to the first rotary actuator; generating a radial force axially along a longitudinal axis of a vehicle chassis via the first central bell crank connected to the first connecting rod; transferring the radial force along a transverse axis across the longitudinal axis of the vehicle chassis via a first bell crank linked to the first central bell crank; and transmitting the radial force dispersed through the first bell crank through a first member to a first vertical suspension assembly with sufficient force to enable the first wheel to lift or lower the left side of the vehicle chassis, and operating a second rotary actuator to generate a pull force via a second connecting rod connected to a second rotary actuator; generating a radial force axially along a longitudinal axis of a vehicle chassis via a second central bell crank connected to the second connecting rod; transferring the radial force along a transverse axis across the longitudinal axis of the vehicle chassis via a second bell crank linked to the second central bell crank; and transmitting the radial force dispersed through the second bell crank through a second member to a second vertical suspension assembly with sufficient force to enable the second wheel to lift or lower the left side of the vehicle chassis, wherein the first and second rotary actuators can be concurrently operated to with sufficient force to enable the first wheel and the second wheel to concurrently lift or lower the left side and the right side of the vehicle chassis, and lift the vehicle chassis with sufficient force to make the vehicle hop off of the support surface.

Naturally, further objects of the invention are disclosed throughout other areas of the specification, drawings, photographs, and claims.

DETAILED DESCRIPTION OF THE INVENTION

Figure 1:
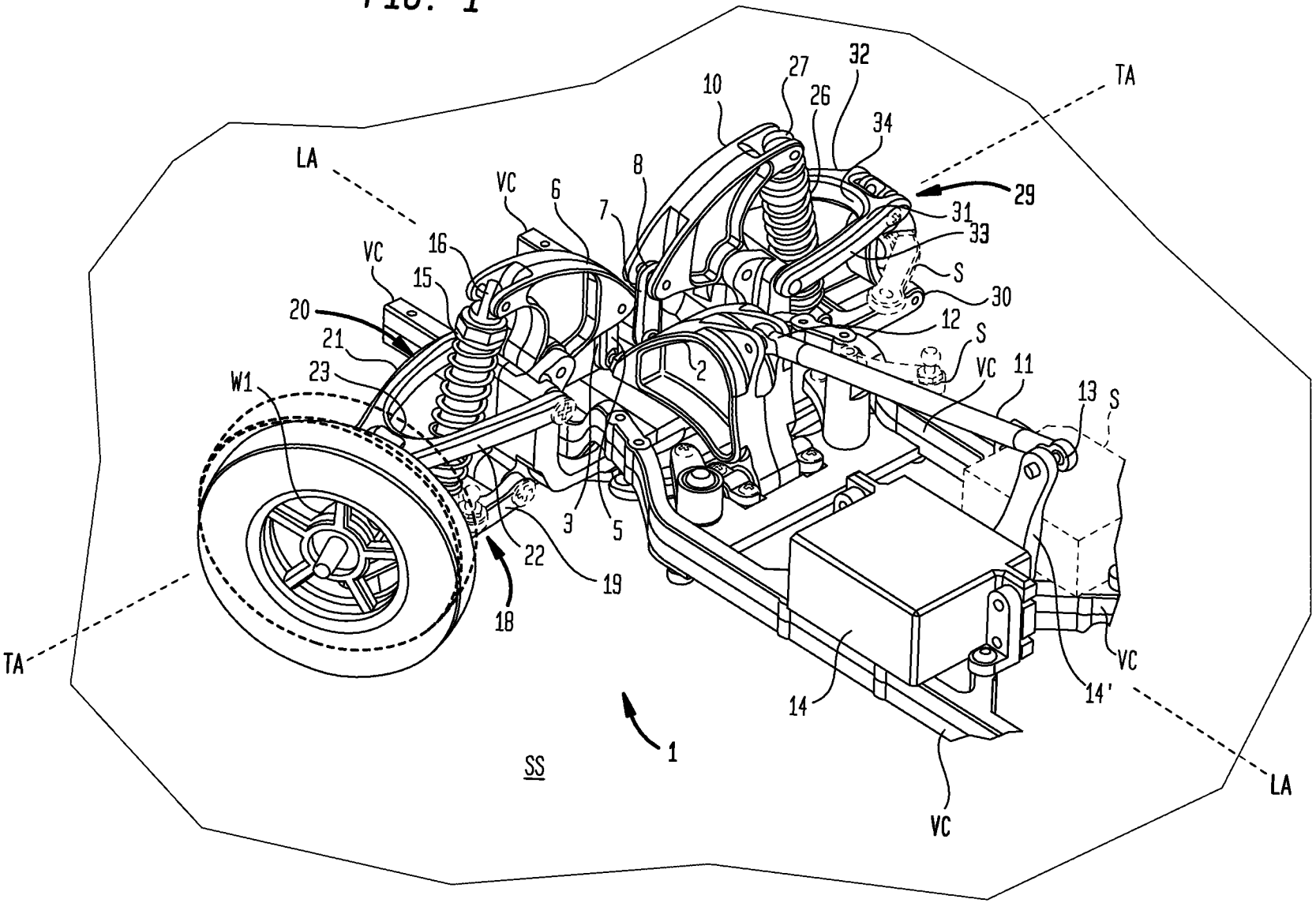
FIG. 1 is a top, left, perspective view of an embodiment of a vehicle suspension.

Generally, with reference to FIGS. 1 through 5 wherein like reference numerals denote like structure throughout the specification, embodiments of a vehicle suspension (1) include a central bell crank (2) pivotally mounted on a vehicle chassis (VC) to axially pivot along a longitudinal axis (LA) of the vehicle chassis (VC). A first bell crank (6) can be pivotally mounted on the vehicle chassis (VC) to transversely pivot along a transverse axis (TA) across the longitudinal axis (LA) of the vehicle chassis (VC). A first link (3) can have a first end (4) pivotally connected to the first bell crank (6) and can have a second end (5) pivotally connected to the central bell crank (2). In particular embodiments, a second bell crank (10) can be pivotally mounted on the vehicle chassis (VC) to transversely pivot along a transverse axis (TA) across the longitudinal axis (LA) of the vehicle chassis (VC). A second link (7) can have a first end (8) pivotally connected to the second bell crank (10) and a second end (9) pivotally connected to the central bell crank (2). A connecting rod (11) can be pivotally connected by a first end (12) to the central bell crank (2) and pivotally connected by a second end (13) to a rotary actuator (14). The rotary actuator (14) can include an actuator horn (14') connected to the second end (13) of the connecting rod (11).

In various embodiments, the central bell crank (2), the first bell crank (6), or the second bell crank (10) can be disposed in various structural forms capable of changing motion through an angle. The illustrative examples of the bell cranks (2) (6) or (10) shown in the Figures are not intended to preclude embodiments which incorporate similar or equivalent crank arms, crank levers, angled levers, suspension arms, or rocker arms, currently or prospectively available, and the fixed pivot or the moving pivots of the bell cranks (2) (6) or (10) can, but need not necessarily, further incorporate a bushing assembly or a bearing assembly to align, guide, or support the bell crank (2) (6) or (10) or reduce wear or friction. Further, while the illustrative examples may show pivot axes defined by pivot pins; this is not intended to preclude the use of pivot balls, pivot joints, ball joints, living hinges, or other structures which allow the fixed pivot or moving pivots of the bell cranks (2) (6) (10) to operate in relation to one another. Further, in various embodiments, the rotary actuator (14) can, but need not necessarily, be a commercially available servo motor used with toy and radio control vehicles. As an illustrative example, a servo motor suitable for use in embodiments can be a Redcat Racing Hexfly HX 15s 200 oz waterproof high torque metal gear servo available from Redcat Racing, 3145 East Washington Street, Phoenix, Arizona 85034. However, this illustrative example of a rotary actuator (14) is not intended to preclude embodiments which incorporate similar or equivalent devices that produce rotary motion or torque, such as high speed and high torque servo motors, currently or prospectively available.

Again, referring primarily to FIGS. 1 through 5, in particular embodiments, the vehicle suspension (1) can further include a first adjustable-length member (15) having a first end mount (16) opposite a second end mount (17). The first adjustable-length member (15) connects to the first bell crank (6) at the first end mount (16). In particular embodiments, the first adjustable-length member (15) can, but need not necessarily, be a commercially available shock absorber or strut used in toy and radio control vehicles. As one illustrative example, an adjustable-length member (15) suitable for use in embodiments, can be a Redcat Racing Shock Absorber Part No. 86002 available from Redcat Racing, 3145 East Washington Street, Phoenix, Arizona 85034. However, the illustrative examples of the first adjustable-length member (15) described in the specification or shown in the Figures are not intended to preclude embodiments which incorporate similar or equivalent toy vehicle shock absorbers, currently or prospectively available. In yet further embodiments, the first adjustable-length members (15) can, but need not necessarily, be a rigid linkage connected to torsion bars, or the like, in or for use with adjustable height suspensions.

Figure 2:
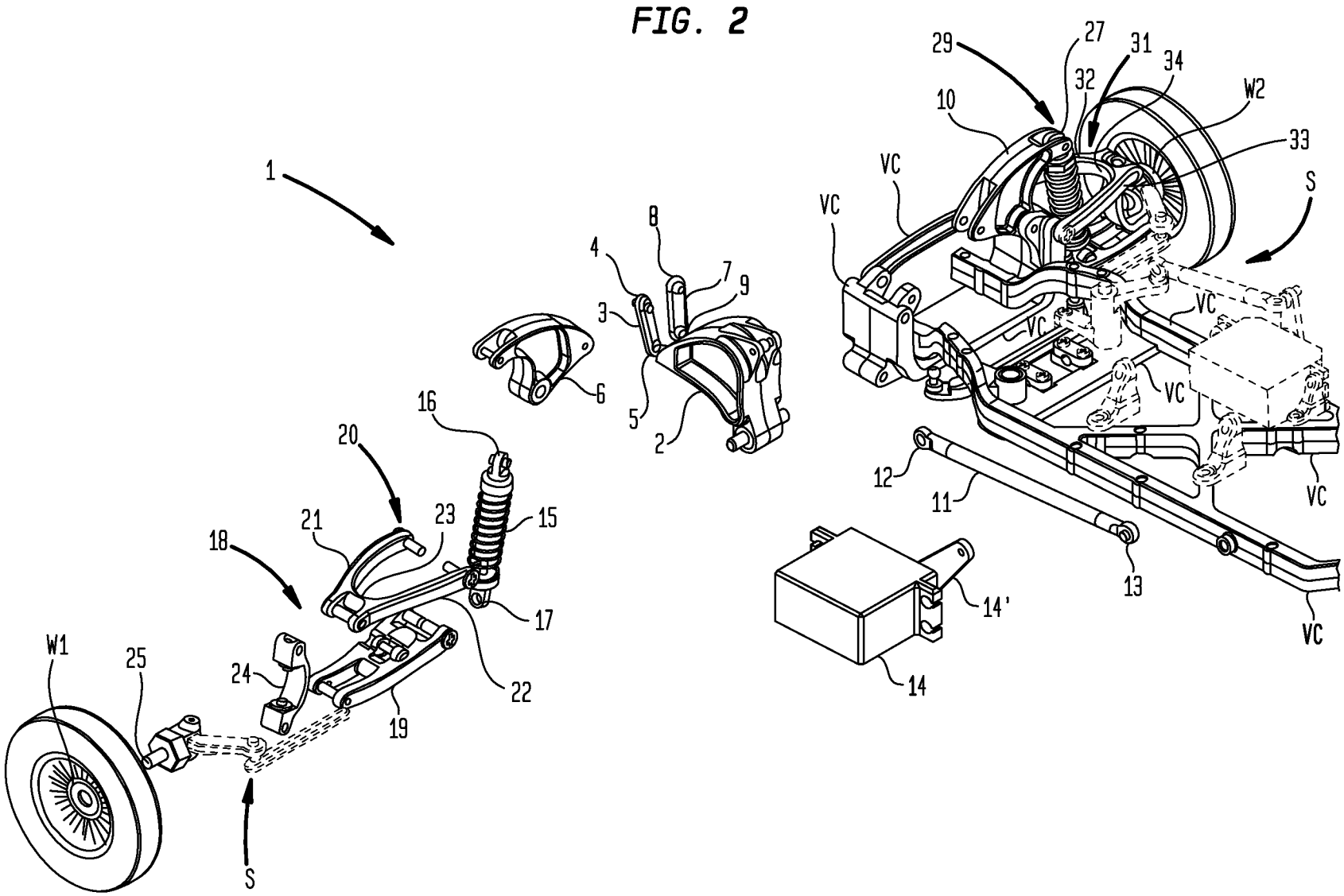
FIG. 2 is a partially exploded, perspective view of an embodiment of a vehicle suspension.
Figure 3:
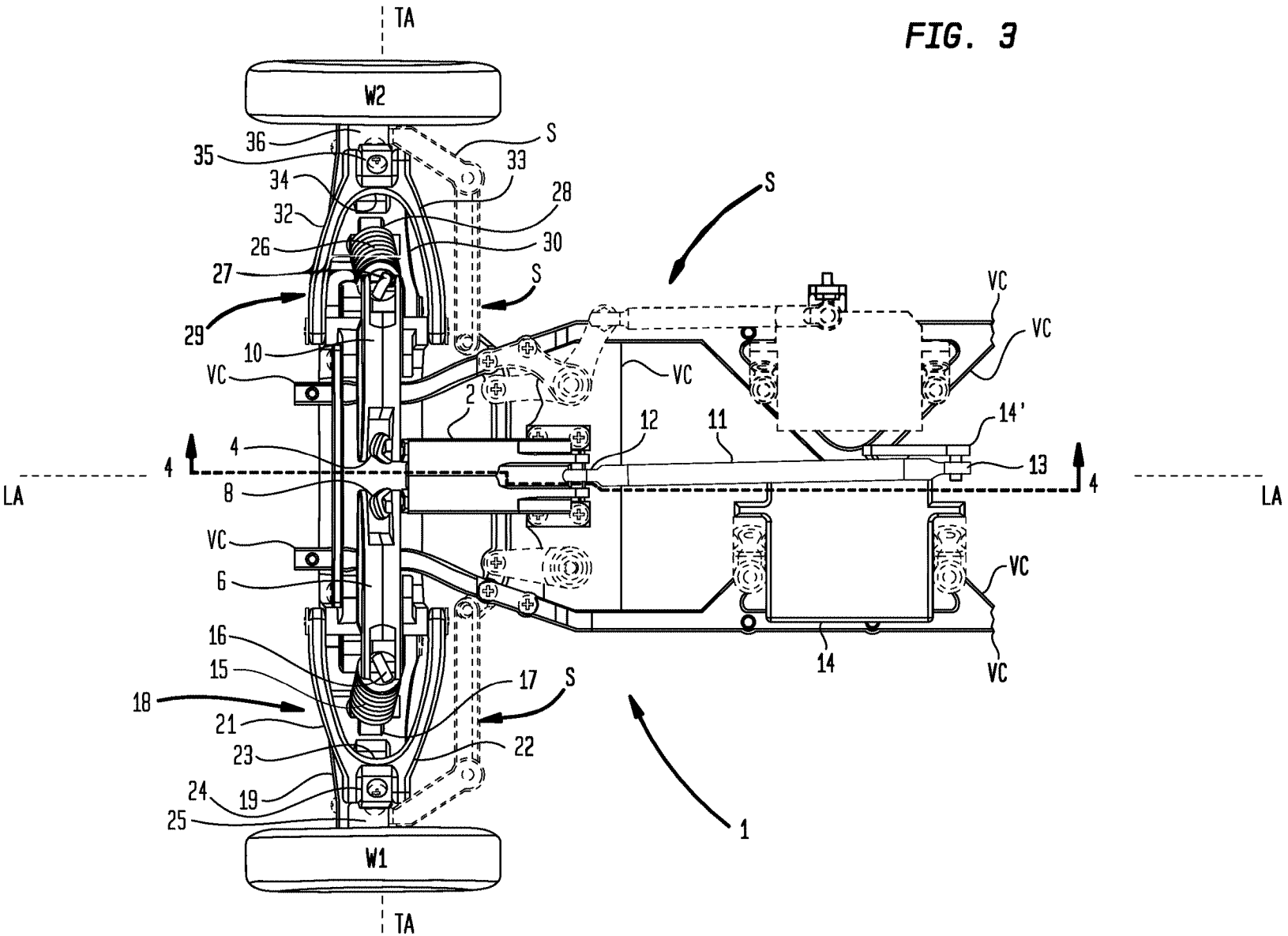
FIG. 3 is a top view of an embodiment of a vehicle suspension.

Now, referring primarily to FIGS. 1 through 3, embodiments of the vehicle suspension (1) can include a first vertical suspension assembly (18) pivotally coupled to the vehicle chassis (VC). The first vertical suspension assembly (18) interconnects a first wheel (W1) to the first adjustable-length member (15) allowing generally vertical movement of the first wheel (W1) in relation to the vehicle chassis (VC). In particular embodiments, the first vertical suspension assembly (18) can include a lower suspension linkage (19) extending from a pivotal coupling on the vehicle chassis (VC) to connect with the second mount (17) of the first adjustable-length member (15), and a first upper wishbone linkage (20) having a first arm (21) and a second arm (22) extending in general parallel relationship to one another (21, 22) from corresponding pivotal couplings on the vehicle chassis (VC) to a first knuckle (23). The first wishbone linkage (20) disposed above the first lower suspension linkage (19), aligns the first mount (16) of the first adjustable-length member (15) connected to the first bell crank (6) with the second mount (17) of the first adjustable-length member (15) connected to the first lower suspension linkage (19) allowing the first adjustable-length member (15) to pass between the first arm (21) and the second arm (22) of the first upper wishbone linkage (20). A first two-ended member (24) can interconnect the first upper wishbone linkage (20) to the first lower suspension linkage (19). A first axle (25) can be rotatably mounted in the first two-ended member (24). The first wheel (W1) can be rotatably coupled to the first axle (25).

Again, referring primarily to FIGS. 1 through 3, the vehicle suspension (1) can further include a second adjustable-length member (26). The second adjustable-length member (26) can have a first mount (27) connected to the second bell crank (10). In substantially similar structural arrangement to the first vertical suspension assembly (18), embodiments can further include, a second vertical suspension assembly (29). The second vertical suspension assembly (29) interconnects a second wheel (W2) to the second adjustable-length member (26). The second vertical suspension assembly (29) can include a second lower suspension linkage (30) connected to a second mount (28) of the second adjustable-length member (26). A second upper wishbone linkage (31) includes a first arm (32) and a second arm (33) which correspondingly extend from pivotal couplings on the vehicle chassis (WC) in a substantially parallel relationship to a second common knuckle (34). The second upper wishbone linkage (31) can be disposed above the second lower suspension linkage (30), to align the first mount (27) of the second adjustable-length member (26) connected to the second bell crank (10) with the second mount (28) of the second adjustable-length member (26) connected to the second lower suspension linkage (30) allowing the second adjustable-length member (26) to pass between the first arm (32) and the second arm (33) of the second upper wishbone linkage (31). The vertical suspension assembly (29) can include a second two-ended member (35) which interconnects the second upper wishbone linkage (31) to the second lower suspension linkage (30). A second axle (36) can be rotatably mounted in the second two-ended member (35). The second wheel (W2) can be rotatably coupled to the second axle (36).

Again, referring primarily to FIGS. 1 through 5, in particular embodiments, the central bell crank (2) can be pivotally mounted on the vehicle chassis (VC) to axially pivot along the longitudinal axis (LA) of the vehicle chassis (VC) interconnecting the connecting rod (11) to the first link (3) and second link (7). The first link (3) and second link (7) can be disposed side-by-side to one another in vertical orientation to connect second ends (5) (9) to the central bell crank (2). Each of the first ends (4), (8) of the first link (3) and the second link (7) can correspondingly couple to the first bell crank (6) and second bell crank (10) each mounted to the vehicle chassis (VC) to transversely pivot across the longitudinal axis (LA) of the vehicle chassis (VC). Operation of the rotary actuator (14) moves the connecting rod (11) to generate operative interconnection between the central bell crank (2), the first bell crank (6) and the second bell cranks (10) to concurrently transfer sufficient force through the first adjustable-length member (15) and the second adjustable-length member (26) to downwardly lower the first vertical suspension assembly (18) and the second vertical suspension assembly (29) in relation to the vehicle chassis (VC) to correspondingly upwardly raise the vehicle chassis (VC) in relation to the support surface (SS). In particular embodiments, the downward movement of the first vertical suspension assembly (18) and the second vertical suspension assembly (29) can occur with sufficient force to cause the first wheel (W1) and the second wheel (W2) to hop off the support surface (SS), whether the vehicle is either stationary or in motion. In particular embodiments, the rotary actuator (14) can be repeatedly actuated to cause a repeated hopping motion of the vehicle chassis (VC) in relation to the support surface (SS).

Now referring primarily to FIGS. 1, 2 and 3, the rotary actuator (14) can, but need not necessarily, have a square center section with opposite extending brackets for mounting to the vehicle chassis (VC). The rotary actuator (14) in operation via radio control, can be connected to an offset actuator horn (14'), which can be connected to a second end (13) of the connecting rod (11). When the rotary actuator (14) actuates the connecting rod (11), the radial movement of the actuator horn (14') can converted into movement in the form of a rearward pull of the connecting rod (11).

Figure 4:
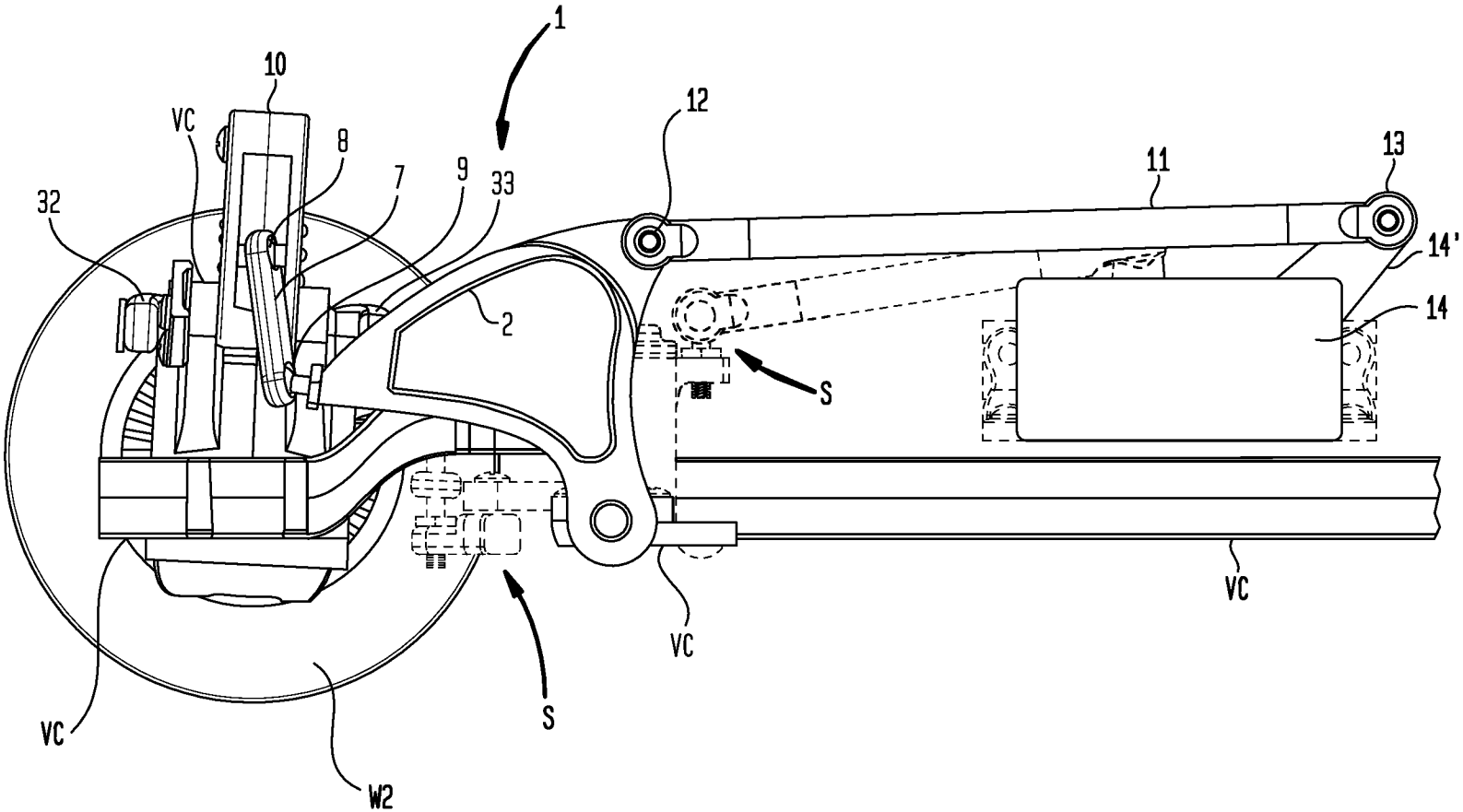
FIG. 4 is a cross-sectional view 4-4 of an embodiment of a vehicle suspension shown in FIG. 3.
Figure 5:
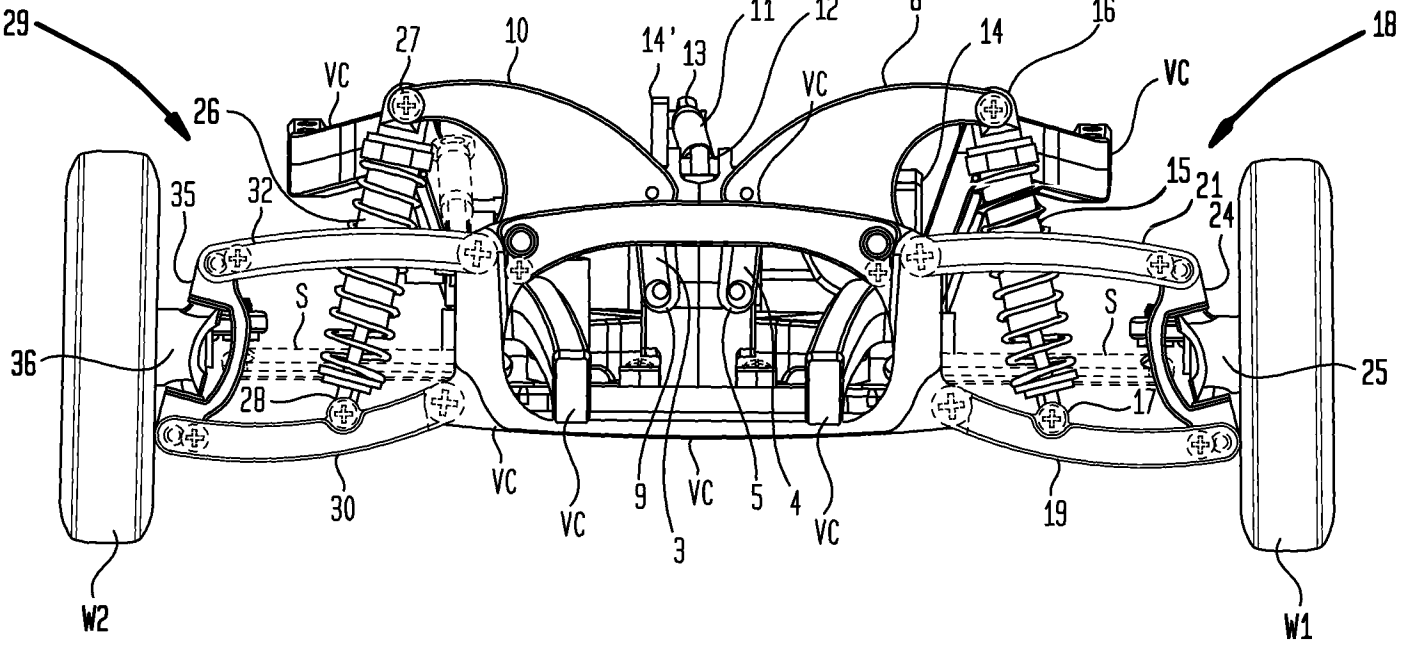
FIG. 5 is a front view of an embodiment of a vehicle suspension.
Figure 6:
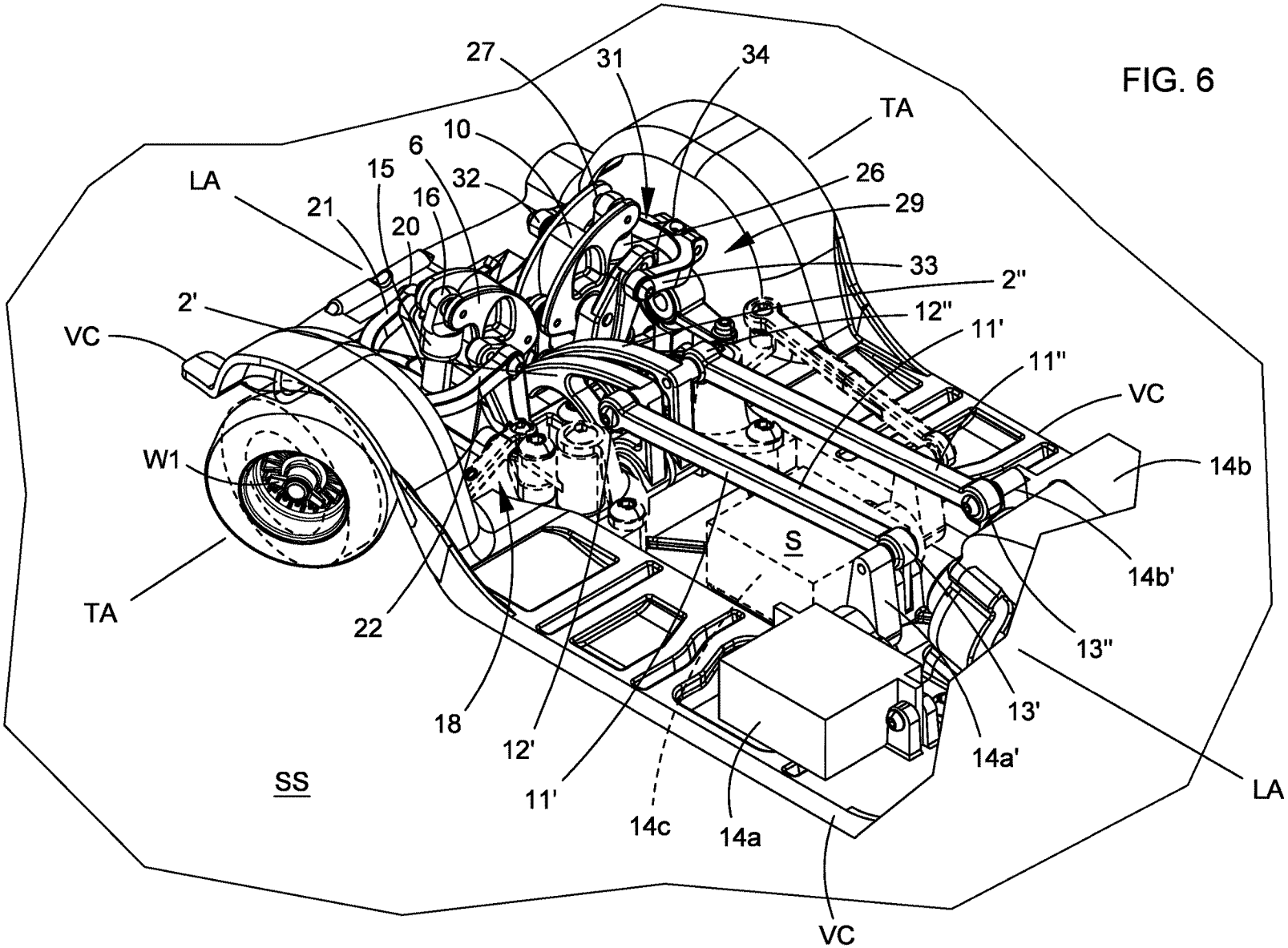
FIG. 6 is a top, left, perspective view of another embodiment of a vehicle suspension.
Figure 7:
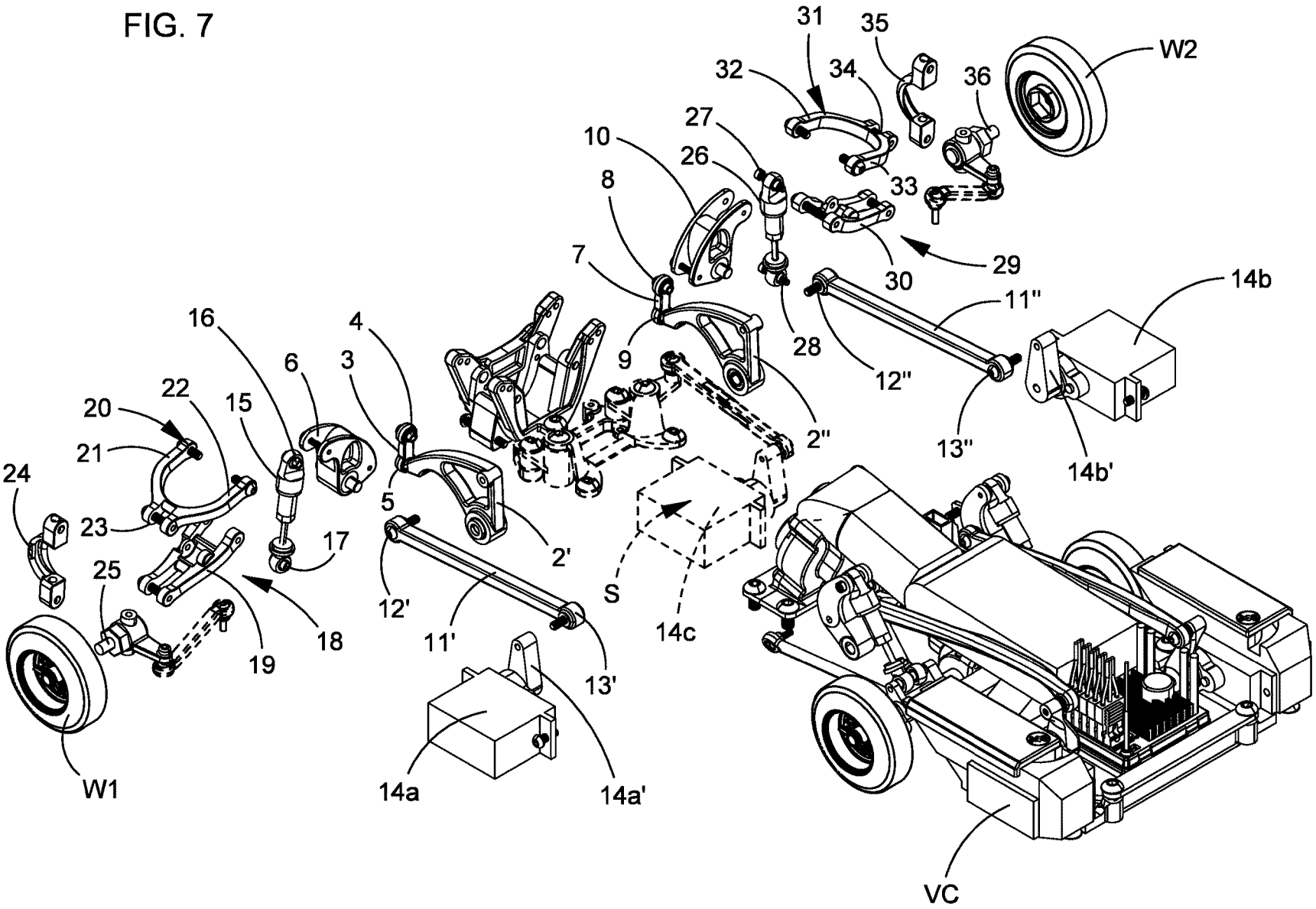
FIG. 7 is an exploded, perspective view of the embodiment of the vehicle suspension depicted in FIG. 6.
Figure 8:
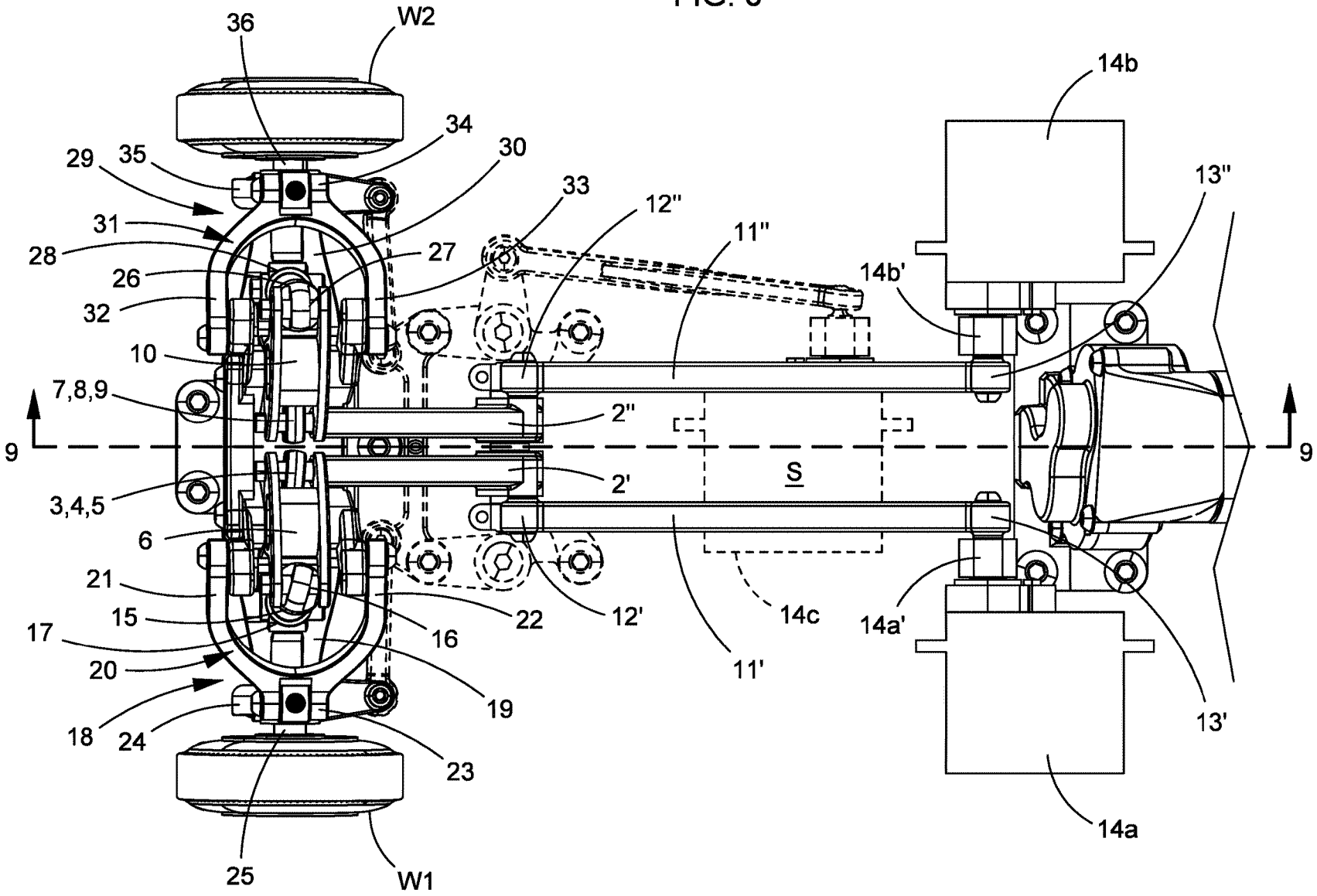
FIG. 8 is a top view of the embodiment of a vehicle suspension depicted in FIG. 6 with the vehicle chassis removed.
Figure 9:
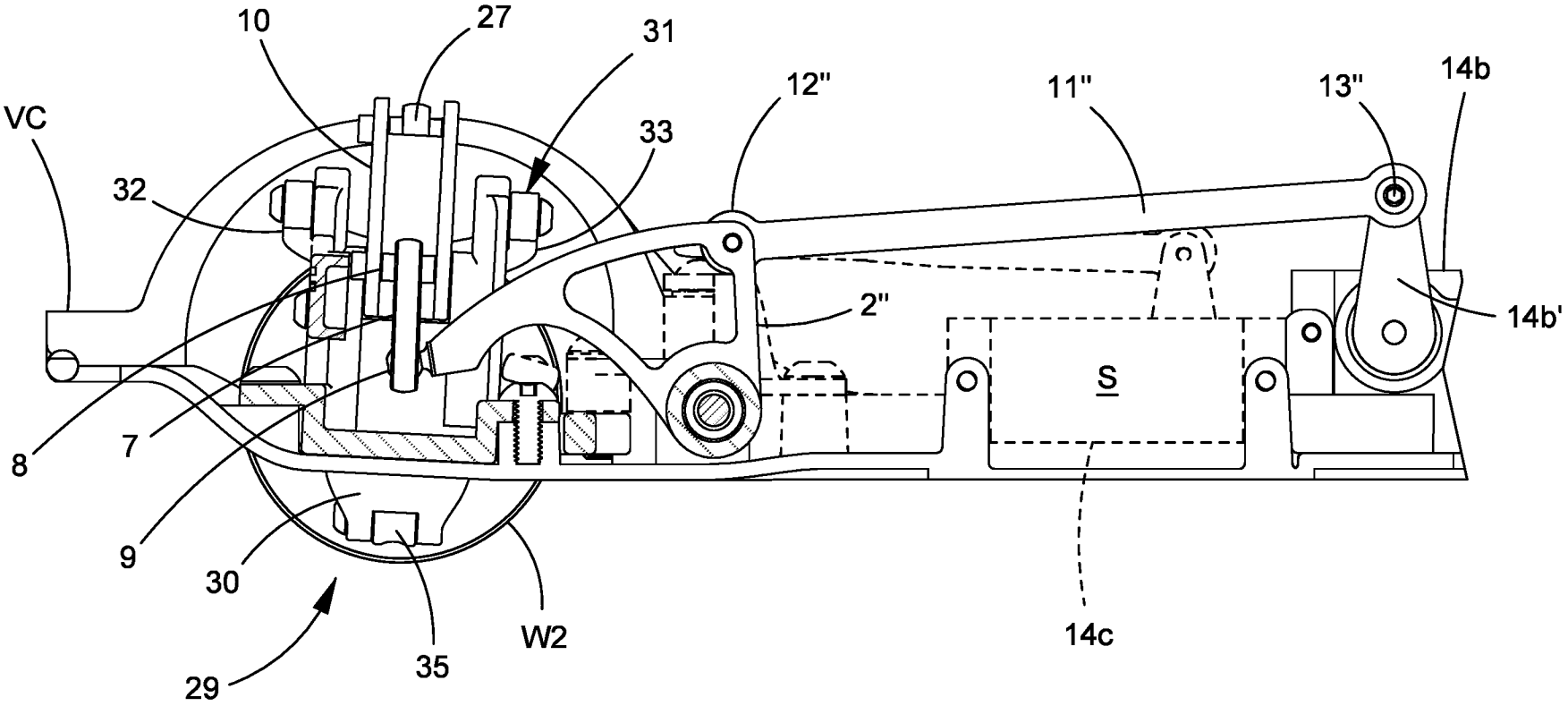
FIG. 9 is a cross-sectional view 9-9 of the embodiment of a vehicle suspension shown in FIG. 8.
Figure 10:
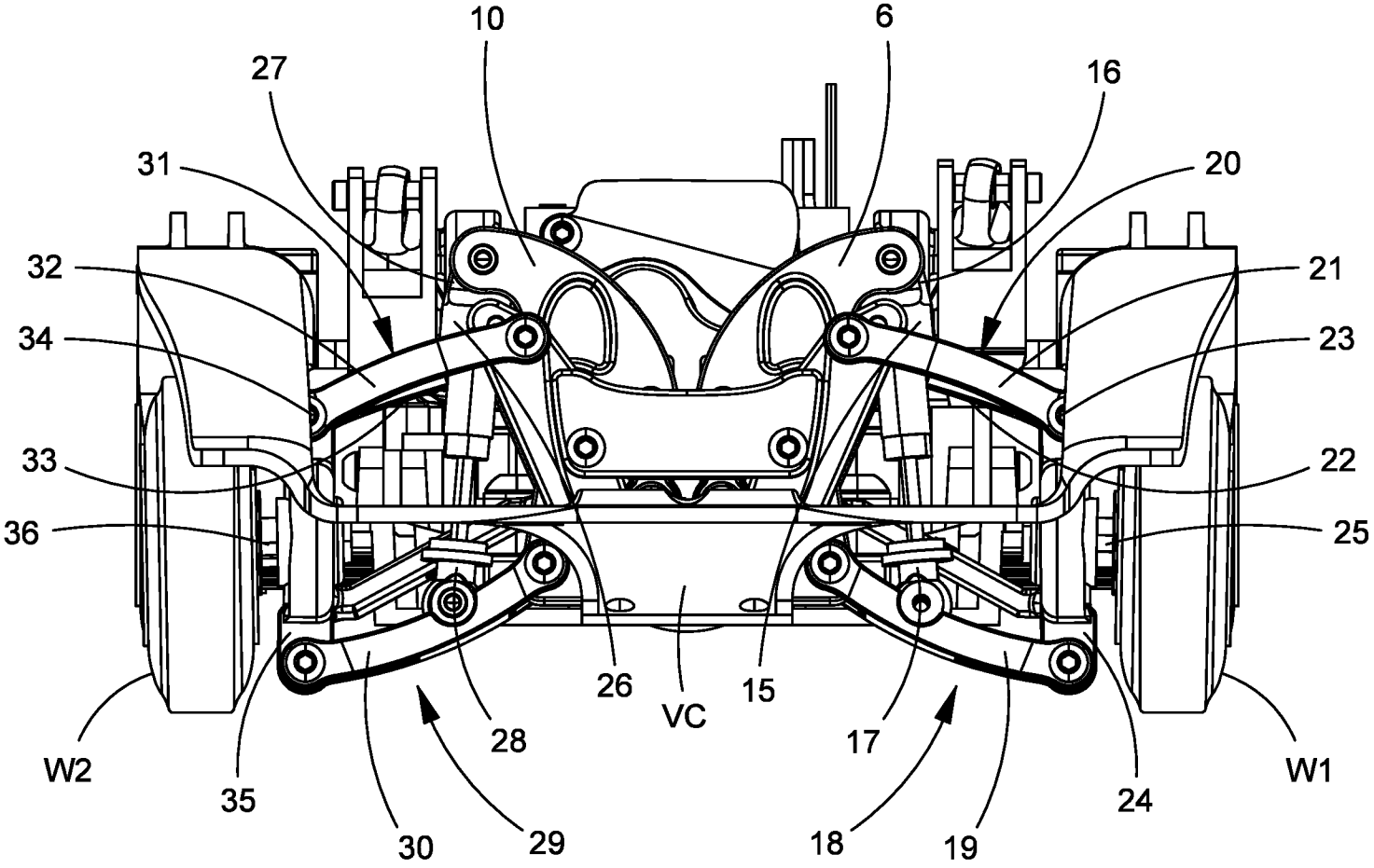
FIG. 10 is a front view of the embodiment of a vehicle suspension depicted in FIG. 6.

Now, referring primarily to FIGS. 3 and 4, a steering linkage (S) (shown in broken line) can, but need not necessarily, be operated by an additional rotary actuator (14*c*) via radio control.

Now, with general reference to FIGS. 6 through 10, in particular embodiments, the central bell crank (2) can comprise a first central bell crank (2') and a second central bell crank (2"). The first central bell crank (2') and the second central bell crank (2") can each be pivotally mounted on the vehicle chassis (VC) to axially pivot along the longitudinal axis (LA) of the vehicle chassis (VC). The first bell crank (6) and the second bell crank (10) can be pivotally mounted on the vehicle chassis (VC) to transversely pivot along the transverse axis (TA) of the vehicle chassis (VC). A first link (3) can have a first end (4) connected to the first bell crank (6) and a second end (5) can be connected to the first central bell crank (2'). A second link (7) can have a first end (8) connected to the second bell crank (10) and a second end (9) can be connected to the second central bell crank (2"). A first end mount (16) of a first member (15) can be connected to the first bell crank (6) and a second end mount (17) of the first member (15) can be connected to a first vertical suspension assembly (18) pivotally coupled to the vehicle chassis (VC). A first wheel (W1) can be interconnected to the first vertical suspension assembly (18). A first end mount (27) of a second member (26) can be connected to the second bell crank (10) and a second end mount (28) of the second member (26) can be connected to a second vertical suspension assembly (29) pivotally coupled to the vehicle chassis (VC). A second wheel (W2) can be interconnected to the second vertical suspension assembly (29). The first member (15) and the second member (26) can have a fixed non-adjustable length. In particular embodiments, the first member (15) and the second member (26) can correspondingly comprise a first adjustable-length member and a second adjustable-length member. The first adjustable-length member and a second adjustable-length member can be configured as mechanical shock absorber.

Operative interconnection of the first central bell crank (2'), the first bell crank (6), the first member (15), and the first vertical suspension assembly (18) can move the first wheel (W1) independent of movement of the second wheel (W2) to corresponding lift and lower one side of the vehicle chassis (VC) independent of the other side of the vehicle chassis (VC). That is, lift and lower one of the left side or the right side of a vehicle chassis (VC). Operative interconnection of the second central bell crank (2"), the second bell crank (10), the second member (26) and the second vertical suspension assembly (29) can move the second wheel (W2) to lift and lower one side of the vehicle chassis (VC) independent of the other side of the vehicle chassis (VC). That is, lift and lower the other one of the left side or the right side of a vehicle chassis (VC).

A first connecting rod (11') can be pivotally connected by a first end (12') to the first central bell crank (2') and pivotally connected by a second end (13') to a first rotary actuator (14*a*). The first rotary actuator (14*a*) can include an actuator horn (14*a*') connected to the second end (13') of the first connecting rod (11'). Operation of the first rotary actuator (14*a*) moves the first connecting rod (11') to generate operative interconnection between the first central bell crank (2') and the first bell crank (6) to concurrently transfer sufficient force through the first member (15) to downwardly lower the first vertical suspension assembly (18) in relation to the vehicle chassis (VC) to correspondingly upwardly raise one side of the vehicle chassis (VC) in relation to the support surface (SS). In particular embodiments, the downward movement of the first vertical suspension assembly (18) can occur with sufficient force to cause the first wheel (W1) to hop off the support surface (SS), whether the vehicle is either stationary or in motion. In particular embodiments, the first rotary actuator (14*a*) can be repeatedly actuated to cause a repeated hopping motion of one side of the vehicle chassis (VC) in relation to the support surface (SS).

A second connecting rod (11") can be pivotally connected by a first end (12") to the second central bell crank (2") and pivotally connected by a second end (13") to a second rotary actuator (14*b*). The second rotary actuator (14*b*) can include an actuator horn (14*b*') connected to the second end (13") of the second connecting rod (11"). Operation of the second rotary actuator (14*b*) moves the second connecting rod (11") to generate operative interconnection between the second central bell crank (2"), the second bell crank (10) to concurrently transfer sufficient force through the second member (26) to downwardly lower the second vertical suspension assembly (29) in relation to the vehicle chassis (VC) to correspondingly upwardly raise the other side of the vehicle chassis (VC) in relation to the support surface (SS). In particular embodiments, the downward movement of the second vertical suspension assembly (18) can occur with sufficient force to cause the second wheel (W2) to hop off the support surface (SS), whether the vehicle is either stationary or in motion. In particular embodiments, the second rotary actuator (14*b*) can be repeatedly actuated to cause a repeated hopping motion of the other side of the vehicle chassis (VC) in relation to the support surface (SS).

Each of the first rotary actuator (14*a*) and the second rotary actuator (14*b*) can operated independent of the other rotary actuator, to allow each side of the vehicle chassis (VC) to be independently raised and lowered independent of the other side of the vehicle chassis (VC). Each of the first rotary actuator (14*a*) and the second rotary actuator (14*b*) can operated concurrently to concurrently raise and lower both sides of the vehicle chassis (VC). In particular embodiments, the first rotary actuator (14*a*) and the second rotary actuator (14*b*) can be repeatedly actuated to cause a repeated hopping motion of both wheels (W1, W2) in relation to the support surface (SS).

As can be easily understood from the foregoing, the basic concepts of the present invention may be embodied in a variety of ways. The invention involves numerous and varied embodiments of a vehicle suspension apparatus, a method of making a vehicle suspension, a method of using a vehicle suspension apparatus to make a remote control car hop, and the component parts thereof, including the best mode.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "crank" should be understood to encompass disclosure of the act of "cranking"—whether explicitly discussed or not—and, conversely, were there effectively disclosure of the act of "cranking", such a disclosure should be understood to encompass disclosure of a "crank" and even a "means for cranking." Such alternative terms for each element or step are to be understood to be explicitly included in the description.

In addition, as to each term used it should be understood that unless its utilization in this application is inconsistent with such interpretation, common dictionary definitions should be understood to be included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a person of ordinary skill in the art would consider as having the same function or result. When a particular element is expressed as an approximation by use of the antecedent "substantially," it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

Thus, the applicant(s) should be understood to claim at least: i) the vehicle suspension apparatus disclosed and described, ii) the related methods and systems disclosed and described, iii) similar, equivalent, and even implicit variations of each of the structure and method, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

Additionally, the claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

We claim:

1. A toy vehicle, comprising:

a first central bell crank pivotally mounted on a vehicle chassis, said first central bell crank mounted to axially pivot along a longitudinal axis of said vehicle chassis;

a first bell crank pivotally mounted on said vehicle chassis, said first bell crank mounted to transversely pivot along a transverse axis of said vehicle chassis;

a first link having a first end connected to said first bell crank and a second end connected to said first central bell crank;

a first mount of a first member connected to said first bell crank;

a second mount of said first member connected to a first vertical suspension assembly pivotally coupled to said vehicle chassis; and a first wheel interconnected to said first vertical suspension assembly, wherein operative interconnection of said first central bell crank, said first bell crank and said first member move said first wheel.

2. The toy vehicle of claim 1, wherein said first vertical suspension assembly comprises a first lower suspension linkage connected to said second mount of said first member.

3. The toy vehicle of claim 2, wherein said first vertical suspension assembly further comprises a first upper wishbone linkage disposed above said first lower suspension linkage, said first upper wishbone linkage having a first arm and a second arm each correspondingly extending outward from a pivotal coupling on said vehicle chassis to a first knuckle.

4. The toy vehicle of claim 3, wherein said first vertical suspension assembly further comprises a first two-ended member interconnecting said first upper wishbone linkage to said first lower suspension linkage; and a first axle rotatably mounted in said two-ended member;

said first wheel rotatably coupled to said first axle.

5. The toy vehicle of claim 4, wherein said first member comprises a first adjustable-length member.

6. The toy vehicle of claim 5, wherein said first adjustable-length member comprises a first strut assembly or a first shock absorber.

7. The toy vehicle of claim 4, further comprising a first connecting rod having a first end pivotally connected to said first central bell crank and a second end pivotally connected to a first rotary actuator.

8. The toy vehicle of claim 7, wherein said first rotary actuator comprises a first servo motor.

9. The toy vehicle of claim 8, wherein operation of said first rotary actuator generates linear movement of said connecting rod to generate operative interconnection of said first central bell crank, said first bell crank and said first adjustable-length member to move said first vertical suspension assembly.

10. The toy vehicle of claim 9, further comprising a second central bell crank pivotally mounted on said vehicle chassis, said second central bell crank mounted to axially pivot along said longitudinal axis of said vehicle chassis;

a second bell crank pivotally mounted on said vehicle chassis, said second bell crank mounted to transversely pivot along a transverse axis of said vehicle chassis;

a second link having a first end connected to said second bell crank and a second end connected to said second central bell crank;

a first mount of a second member connected to said second bell crank;

a second mount of said second member connected to a second vertical suspension assembly pivotally coupled to said vehicle chassis; and a second wheel interconnected to said second vertical suspension assembly, wherein operative interconnection of said second central bell crank, said second bell crank and said second member move said second wheel.

11. The toy vehicle of claim 10, wherein said second vertical suspension assembly comprises a second lower suspension linkage connected to said second mount of said second adjustable-length member.

12. The toy vehicle of claim 11, wherein said second vertical suspension assembly further comprises a second upper wishbone linkage disposed above said second lower suspension linkage, said second upper wishbone linkage having a first arm and a second arm each correspondingly extending outward from a pivotal coupling on said vehicle chassis to a second knuckle.

13. The toy vehicle of claim 12, wherein said second vertical suspension assembly further comprises:

a second two-ended member interconnecting said second upper wishbone linkage to said second lower suspension linkage; and a second axle rotatably mounted m said two-ended member, said second wheel rotatably coupled to said second axle.

14. The toy vehicle of claim 13, wherein said second member comprises a second adjustable-length member.

15. The toy vehicle of claim 14, wherein said second adjustable-length member comprises a second strut assembly or a second shock absorber.

16. The toy vehicle of claim 13, further comprising a second connecting rod having a first end pivotally connected to said second central bell crank and a second end pivotally connected to a second rotary actuator.

17. The toy vehicle of claim 16, wherein said second rotary actuator comprises a second servo motor.

18. The toy vehicle of claim 17, wherein operation of said first rotary actuator generates linear movement of said first connecting rod to generate operative interconnection of said first central bell crank, said first bell crank and said first member to move said first vertical suspension assembly.

19. The toy vehicle of claim 18, wherein said first connecting rod operatively interconnects said first central bell crank to said first rotary actuator.

20. The toy vehicle of claim 19, wherein a pull force generated from operative interconnection between said first central bell crank and said first rotary actuator causes said first wheel to dependently move downward.

21. The toy vehicle of claim 19, wherein a push force generated from operative interconnection between said first central bell crank and said first rotary actuator causes said first wheel to dependently move upward.

22. The toy vehicle of claim 19, wherein said second connecting rod operatively interconnects said second central bell crank to said second rotary actuator.

23. The toy vehicle of claim 22, wherein a pull force generated from an operative interconnection between said second central bell crank and said second rotary actuator causes said second wheel to dependently move downward.

24. The toy vehicle of claim 22, wherein a push force generated from an operative interconnection between said second central bell crank and said second rotary actuator causes said first wheel to dependently move upward.

25. The toy vehicle of claim 22, wherein a concurrent pull force generated from operative interconnection between said first central bell crank and said first rotary actuator and from operative interconnection between said second central bell crank and said second rotary actuator causes said first wheel and said second wheel to concurrently dependently move downward.

26. The toy vehicle of claim 22, wherein a concurrent push force generated from an operative interconnection between said first central bell crank and said first rotary actuator and from operative interconnection between said second central bell crank and said second rotary actuator causes said first wheel and said second wheel to concurrently dependently move upward.

27. The toy vehicle of claim 26, wherein said first rotary actuator and said second rotary actuator each independently or concurrently operated by a radio control.

28. The toy vehicle of claim 27, wherein said toy vehicle is a radio control toy vehicle.

29. The toy vehicle of claim 1, further comprising a second central bell crank pivotally mounted on said vehicle chassis, said second central bell crank mounted to axially pivot along said longitudinal axis of said vehicle chassis;

a second bell crank pivotally mounted on said vehicle chassis, said second bell crank mounted to transversely pivot along a transverse axis of said vehicle chassis;

a second link having a first end connected to said second bell crank and a second end connected to said second central bell crank;

a first mount of a second member connected to said second bell crank;

a second mount of said second member connected to a second vertical suspension assembly pivotally coupled to said vehicle chassis; and a second wheel interconnected to said second vertical suspension assembly to a second wheel, wherein operative interconnection of said second central bell crank, said second bell crank and said second member move said second wheel.

* * * * *